US005266434A

United States Patent [19]

Hirayama et al.

[11] Patent Number: 5,266,434

[45] Date of Patent: Nov. 30, 1993

[54] ELECTROPHOTOGRAPHIC TONER COMPOSITION

[75] Inventors: Nobuhiro Hirayama, Hiratsuka; Kenji Uchiyama, Odawara; Shoji Kawasaki; Hisatomo Sato, both of Yokohama; Hiromi Akiyama, Hiratsuka, all of Japan

[73] Assignee: Mitsui Toatsu Chemicals, Incorporated, Tokyo, Japan

[21] Appl. No.: 730,900

[22] PCT Filed: Dec. 11, 1990

[86] PCT No.: PCT/JP90/01616

§ 371 Date: Aug. 6, 1991

§ 102(e) Date: Aug. 6, 1991

[87] PCT Pub. No.: WO91/09347

PCT Pub. Date: Jun. 27, 1991

[30] Foreign Application Priority Data

Dec. 12, 1989 [JP] Japan ..... 1-320609

[51] Int. Cl.[5] ..... B03G 9/08

[52] U.S. Cl. ..... 430/111; 430/109; 430/904

[58] Field of Search ..... 430/109, 111, 904, 110

[56] References Cited

U.S. PATENT DOCUMENTS

| | | | |
|---|---|---|---|
| 4,702,986 | 10/1987 | Imai et al. | 430/120 |
| 4,939,060 | 7/1990 | Tomiyama et al. | 430/106.6 |
| 4,963,456 | 10/1990 | Shin et al. | 430/109 |
| 5,084,368 | 1/1992 | Hirayama et al. | 430/109 |
| 5,112,714 | 5/1992 | Imai et al. | 430/106.6 |

*Primary Examiner*—Marion E. McCamish
*Assistant Examiner*—Rosemary Ashton
*Attorney, Agent, or Firm*—Oblon, Spivak, McClelland, Maier & Neustadt

[57] ABSTRACT

The present invention provides an electrophotographic toner composition comprising a binder and a colorant. At least 70 wt. % of the binder are soluble in THF, the number average molecular weight (Mn) and Z average molecular weight (Mz) of the THF-soluble portion of the binder as measured using THF are 2,000–15,000 and at least 400,000, respectively. The particle size of the binder has been controlled so that $D_{75}$ is not greater than 2.5 mm, $D_{25}$ not smaller than 0.15 mm and $D_{75}/D_{25}$ at least 1.5. The toner composition does not have variations from one lot to another. The quantity of electricity to be charged during a copying operation changes little. The picture quality can be maintained constant even during a long-time copying operation.

16 Claims, No Drawings

ELECTROPHOTOGRAPHIC TONER COMPOSITION

TECHNICAL FIELD

This invention relates to an electrophotographic toner composition suitable for use in developing electrostatic latent images in electrophotography, electrostatic recording, electrostatic printing and the like.

BACKGROUND ART

In electrophotography, the copying speed tends to increase further in recent years to meet the ever increasing quantity of information to be dealt with. In high-speed photography, there is hence the tendency that the number of copies increases further. It is desired that image quality has the same quality from the first copy to the several ten thousandth copy, to say nothing of the need for complete fixing of toner on paper sheets. It has, however, been attempted primarily to improve problems which occur after fixing of the toner on paper sheet, for example, to improve offset property and low-temperature fixing property. No substantial attention has, however, been paid to the need for uniform deposition of the toner at a constant concentration on the paper sheet in each copy. The quantity of electrostatic charge on toner is an important factor for determining the amount of the toner to be deposited on the paper sheet. It has been known that image density can be controlled by this mechanism. Triboelectric charging, however, takes place by friction between toner and a carrier, for example, in a two-component developer. Agglomerates of fine particles of a colorant such as carbon black and an undispersed charge control agent, said colorant and charge control agent being contained in the toner, often induce fouling of a carrier and a photosensitive member.

Such agglomerates and undispersed charge control agent are also responsible for troubles such as background scumming, variation of image density, and image quality due to a damaged photoconductor. It has been attempted to solve these troubles by choosing, in combination, conditions such as the temperature upon kneading, residence time and the type of screw(s) for a kneader and/or by modifying kneading conditions such as revolution speed and the dispersion method. Despite these modifications, the above troubles have not been solved yet, for example, toner varies in properties from one lot to another.

As disclosed, for example, in European Patent Publication No. 323513 previously filed naming the same inventors as in the present application, it has been found that a toner composition, which features smaller variations in the quantity of electricity charged during copying, can be provided with excellent high-speed and low-temperature fixing property by using as a binder a uncrosslinked polymer having a number average molecular weight (Mn) of 2,000–15,000 and a Z average molecular weight (Mz) of at least 400,000, the ratio of the Z average molecular weight to the number average molecular weight (Mz/Mn) being 50–600, or a mixture of the uncrosslinked polymer.

However, toner has still been observed to vary in properties from one lot to another even when the above requirements for the Z average molecular weight and the number average molecular weight are met. Differences are also observed among bags when toner is packaged especially from a storage vessel of a large capacity like a silo. It has also been observed that differences occur when the setting of the size for ground particles is changed. As is indicated in the above patent publication, inclusion of a crosslinked polymer even in a small quantity has been known to result in the drawback that the quantity of electricity to be charged varies substantially.

The present inventors thought that it would be difficult to overcome all the problems by simply modifying the conditions required upon heating, melting and kneading a colorant, a charge control agent and the like together with a binder, namely, 1) the high viscosity condition required for disintegrating agglomerates of the colorant and the charge control agent and 2) the low viscosity required for wetting surfaces of disintegrated agglomerates with the binder to improve the uniform dispersibility, in other words, to fully satisfy the flowability conditions by merely modifying mechanical conditions for the premixing stage before the kneading and those for the kneading. As a result, the properties of the binder have been found to vary from one package to another when Mz, which governs the viscosity of the binder, is made larger and Mn, which controls the flowability of the binder, is set at a particular value. Further, due to segregation of the binder, the toner has been found to include those having an unduly large average particle size and those containing too much fine powder, i.e., an excessively small average particle size.

Toner having a uniform particle size, from which large and small particles have been excluded, has heretofore been considered ideal. However, this has now been found wrong. It has hence been found that particles of a binder employed upon batchwise premixing for the production of toner are required to contain both particles on the side of larger particle sizes and particles on the side of smaller particle sizes and also that care should be exercised to avoid concentration of particles of a particular particle size due to segregation or the like.

It has also been found that a toner composition—which contains a colorant and charge control agent in a uniformly dispersed state, is free of agglomerates, has excellent electrification stability and can consistently provide pictures of excellent quality during a long-time copying operation—can be obtained by preparing the toner composition through premixing and kneading steps subsequent to adjustment of the particle size of a binder to a specific range. Although the prior art is difficult to uniformly disperse a colorant, a charge control agent and the like because the viscosity varies considerably upon kneading due to cleavage of molecules, it has also been found that a crosslinked polymer can be included in a small amount.

DISCLOSURE OF THE INVENTION

An object of the present invention is to determine causes for the above problems so that the above problems can be improved to obtain an improved toner composition which has no variations from one lot to another and undergoes little variations in the quantity of electricity to be charged during a copying operation.

The above object of the present invention can be achieved by an electrophotographic toner composition comprising a binder and a colorant as principal components and obtained through kneading, grinding and classifying steps after the principal components have been mixed and dispersed in advance. Before the mixing and dispersion, at least 70 wt. % of the binder are soluble in tetrahydrofuran (hereinafter abbreviated as "THF"), the number average molecular weight (Mn) and Z average molecular weight (Mz) of the THF-soluble portion as measured using THF are 2,000–15,000 and at least 400,000, respectively, and the particle size of the binder has been controlled so that $D_{75}$ is not greater than 2.5 mm, $D_{25}$ not smaller than 0.15 mm and $D_{75}/D_{25}$ at least 1.5.

The symbols "$D_{25}$" and "$D_{75}$" as used herein indicate the particle size corresponding to the cumulative weight percentages of 25 wt. % and 75 wt. %, respectively, as cumulated from smaller particle sizes on a cumulative particle size distribution curve.

BEST MODE FOR CARRYING OUT THE INVENTION

To provide a high viscosity needed for disintegrating agglomerates of the colorant and the charge control agent, the binder in the present invention has Mz of at least 400,000 with at least 500,000 being particularly preferred. If Mz is smaller than 400,000, the agglomerate-disintegrating effect is low. Although no particular limitation is imposed on the upper limit of Mz, the upper limit is generally not greater than 4,000,000.

On the other hand, at least 70 wt. %, preferably at least 75 wt. % of the binder are required to be soluble in THF. If the THF-soluble content is lower than 70 wt. %, more molecules are cleaved during kneading, thereby making it difficult to always obtain toner of consistent quality.

To obtain flowability sufficient to wet surfaces of the colorant and charge control agent for the improvement of the uniform dispersibility, Mn should be in the range of 2,000–15,000, with a range of 2,000–10,000 being particularly preferred. Mn smaller than 2,000 results in an unduly low viscosity at the time of kneading, so that the effect for disintegrating agglomerates of the colorant and charge control agent is low. On the other hand, Mn greater than 15,000 impairs the flowability, thereby deteriorating the uniform dispersibility, namely, reducing the wetting effect.

The particle size of the binder is most important in the present invention. The binder may not be fully fused and may be partly discharged where the particle size $D_{75}$ of the binder is greater than 2.5 mm or, in some instances, 2 mm, no matter how much the thermal properties of a binder are suited for kneading. It is hence observed that the colorant and charge control agent are not taken in the binder and are localized. As a result, the uniform dispersibility is significantly impaired, leading to background scumming and, in worse cases, to damages to the photoconductor and streaky disturbance to pictures. If $D_{25}$ is smaller than 0.15 mm or, in some instances, 0.17 mm on the other hand, the uniform mixability of the binder with the colorant and charge control agent can be improved. Slip, however, tends to occur in the kneader, thereby failing to transmit sufficient force to fully disintegrate agglomerates of the colorant and charge control agent. As a result, agglomerates of the colorant and charge control agent may remain or the feeding rates of the raw materials to the kneader may become irregular so that the quality is subjected to substantial variations. In addition, during a continuous operation of a copying machine or an electrophotographic printer, facsimile or the like, stable pictures may not be obtained and, in some worst instances, the photoconductor may be subjected to filming so that pictures may be disturbed. The particle size of the binder considerably affects the premixing and kneading upon production of toner as is understood from the foregoing. Accordingly, the uniformity of a toner composition is adversely affected when the particle size is too large or too small.

For these reasons, it is essential for binder particles to have a broad particle size distribution so that large particles and small particles are both contained together. To satisfy such conditions, $D_{75}/D_{25}$ is set at 1.5 or greater, more preferably at 1.8 or greater. If $D_{75}/D_{25}$ is smaller than 1.5, in other words, the particle size distribution is unduly narrow, it is impossible to achieve both elimination of agglomerates of the colorant and charge control agent and uniformity and also to retain electrification stability during a long-time copying operation, no matter how the average particle size ($D_{50}$) is adjusted. The particle size of the binder, said particle size being required to bring about advantageous effects of the present invention, can be obtained by providing a grinder such as a chopper mill or hammer mill, in which resin lumps forming the binder are comminuted, with a screen to prevent passage of resin particles of a predetermined particle size and greater and hence inclusion of coarse particles and, further, by eliminating fine particles from the resin powder, which has passed through the grinder, in accordance with air classification or by using a sieve.

The resin which forms a binder usable in the present invention can be suitably selected for use, for example, from polymers or copolymers of acrylic acid esters such as methyl acrylate, ethyl acrylate, propyl acrylate, butyl acrylate, octyl acrylate, cyclohexyl acrylate, lauryl acrylate, stearyl acrylate, benzyl acrylate, furfuryl acrylate, tetrahydrofurfuryl acrylate, hydroxyethyl acrylate, hydroxybutyl acrylate, dimethylaminomethyl acrylate ester, and dimethylaminoethyl acrylate ester; methacrylic acid esters such as methyl methacrylate, ethyl methacrylate, propyl methacrylate, butyl methacrylate, octyl methacrylate, lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate, dimethylaminomethyl methacrylate ester, and dimethylaminoethyl methacrylate ester; aromatic vinyl monomers such as vinyltoluene, α-methylstyrene, chlorostyrenes, and styrene; dialkyl esters of unsaturated dibasic acids such as dibutyl maleate, dioctyl maleate, dibutyl fumarate, and dioctyl fumarate; vinyl esters such as vinyl acetate and vinyl propionate; nitrogen-containing vinyl monomers such as acrylonitrile and methacrylonitrile; unsaturated carboxylic acids such as acrylic acid, methacrylic acid and cinnamic acid; unsaturated dicarboxylic acids such as maleic acid, maleic anhydride, fumaric acid, and itaconic acid; monoester of unsaturated dicarboxylic acids such as monomethyl maleate; monoethyl maleate, monobutyl maleate, monooctyl maleate, monomethyl fumarate, monoethyl fumarate, monobutyl fumarate and monooctyl fumarate; other monoolefinically unsaturated compounds such as styrenesulfonic acid, acrylamide, methacrylamide, N-substituted acrylamide, N-substituted methacrylamide, and acrylamidopropanesulfonic acid; divinyl compounds such as divinylbenzene, (poly)ethyleneglycol diacrylate, and (poly)ethyleneglycol dimethacrylate; and unsaturated conjugated diolefin monomers such as butadiene, chloroprene, neoprene and isoprene. Among these, acrylic ester resins, methacrylic acid resin, styrene resin, acrylic esters, styrene copolymer resins, methacrylic esters, styrene copolymer resins, acrylic esters, methacrylic esters, styrene copolymer resins, fumaric esters, styrene copolymer resins, maleic esters, styrene copolymer resins, styrene, butadiene copolymer resins, and the like are preferred.

In the present invention, the Z average molecular weight of the binder can be controlled to 400,000 or higher, preferably by conducting bulk polymerization of an unsaturated monomer to a high polymerization rate without using any polymerization initiator or conducting bulk polymerization of an unsaturated monomer in combination with an unsaturated carboxylic acid such as methacrylic acid, in the case of the solution polymerization process; by adding a polymerization initiator and a divinyl compound after the bulk polymerization and, subsequent to dilution of the resultant mixture with a great deal of a solvent, allowing the reaction to continue; or by polymerizing an unsaturated monomer in the presence of a large amount of a solvent and a divinyl compound.

Mn of 2,000–15,000, which is required in the present invention, can be obtained by a process in which, subsequent to bulk polymerization, a polymerization initiator and a solvent and, if necessary, a monomer is added in the presence of an unreacted monomer, followed by the production of a low molecular weight polymer. The above Mn can also be obtained by uniformly mixing the above-described polymer, which has the large Z average molecular weight, with a low molecular weight polymer prepared separately in advance and having Mn of 1,500–15,000 in accordance with a method in which the individual polymers are stirred and mixed in a state separately dissolved in the same solvent or in mutually-miscible solvents, respectively, or in accordance with a method in which the individual polymers are stirred or at a temperature not lower than their melting points or are mixed in an extruder or the like.

Further, suspension polymerization or emulsion polymerization is generally used to increase the molecular weight of a high molecular material. Since an emulsifier or dispersant employed upon polymerization is contained in both water as a dispersing medium and polymer particles, it is difficult to fully remove the emulsifier or dispersant and also to remove such an impurity to a predetermined constant level. When the resultant polymer is employed as a binder in toner, the toner is considerably affected by the humidity of the surrounding environment, thereby making it difficult to achieve the objects of the present invention, i.e., to reduce variations in the quantity of electricity to be charge during a long-time, continuous copying operation and to always obtain copies of constant quality in the course of the copying operation. Even if the removal of impurities such as an emulsifier and the like can be sufficiently conducted, the polymer so produced has a small particle size and a sharp particle size distribution in general. To control the particle size and particle size distribution within their corresponding ranges specified in the present invention, it is hence necessary to blend several types of resins having different particle sizes, to grind larger resin particles to broaden the particle size distribution, or to heat and fuse the resin, cool the fused resin into resin lumps and then mechanically grind the lumps. The efficiency of production is therefore poor so that these methods are not preferred. It is hence preferred to employ solution polymerization or bulk polymerization which is less accompanied by these drawbacks.

Upon solution polymerization, aromatic hydrocarbons such as benzene, toluene, ethylbenzene, orthoxylene, metaxylene, paraxylene and cumene are used either singly or in combination as a solvent. It is however possible to control the molecular weight by choosing one or more other solvents.

The solution polymerization is usually conducted at a reaction temperature of 80°–150° C. but, for the adjustment of the molecular weight, can be conducted at a temperature outside the above range. In the solution polymerization, any polymerization initiator usable as a radical polymerization initiator can be used in general. Examples of the polymerization initiator include azo initiators such as 2,2'-azobisisobutyronitrile, 2,2'-azobis(4-methoxy-2,4-dimethylvaleronitrile), 2,2'-azobis(-2,4-dimethylvaleronitrile), 2,2'-azobis(-2 methylvaleronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, and 2,2'-azobis(2-methyl-propane); ketone peroxides such as methyl ethyl ketone peroxide, acetylacetone peroxide and cyclohexanone peroxide; peroxyketals such as 1,1-bis(t-butylperoxy)-3,3,5-trimethylcyclohexane, 1,1-bis(-butylperoxy)cyclohexane and 2,2-bis(t-butylperoxy)butane; hydroperoxides such as t-butyl hydroperoxide, cumene hydroperoxide, and 1,1,3,3-tetramethyl hydroperoxide; dialkyl peroxides such as di-t-butyl peroxide, t-butylcumyl peroxide, di-cumyl peroxide, 2,5-dimethyl-2,5-di(t-butylperoxy)hexane, and $\alpha,\alpha'$-bis(t-butyl peroxyisopropyl)benzene; diacyl peroxides such as isobutyryl peroxide, octanoyl peroxide, decanoyl peroxide, lauroyl peroxide, 3,5,5-trimethylhexanoyl peroxide, benzoyl peroxide, and m-toluoyl peroxide; peroxycarbonates such as di-isopropylperoxydicarbonate, di-2-ethylhexylperoxydicarbonate, di-n-propylperoxydicarbonate,di-2-ethoxyethylperoxycarbonate, di-methoxyisopropylperoxydicarbonate, and di(3-methyl-3-methoxybutyl)peroxycarbonate; sulfonyl peroxides such as acetylcyclohexylsulfonyl peroxide; peroxy esters such as t-butyl peroxyacetate, t-butyl peroxyisobutylate, t-butyl peroxyneodecanoate, cumyl peroxyneodecanoate, t-butyl peroxy-2-ethylhexanoate, t-butyl peroxylaurate, t-butyl peroxybenzoate, t-butyl peroxyisopropylcarbonate, and di-t-butyl peroxyisophthalate. The kind and amount of the initiator can be suitably selected, depending on the reaction temperature, monomer concentrations or the like.

The toner according to the present invention is primarily a powder-like, dry toner. The above-described polymer or polymer mixture, a principal component of the toner, is required to be a solid at room temperature. The polymer or polymer mixture is also required to remain free from fusion bonding during grinding and, after formulated into the toner, not to develop caking even when left over for a long time. From such viewpoints, the glass transition point of the polymer or polymer mixture is preferably at least 40° C., more preferably at least 50° C. From the viewpoint of low-temperature fixing property, it is preferred that the polymer or polymer mixture becomes soft at a temperature as low as possible. From this viewpoint, the glass transition point is preferably 90° C. or lower, more preferably 80° C. or lower.

As the binder in the present invention, for example, a part of polyvinyl chloride, polyvinyl acetate, polyolefins, polyesters, polyvinyl butyral, polyurethanes, polyamides, rosin, modified rosins, terpene resins, phenol resins, aliphatic hydrocarbon resins, aromatic petroleum resins, paraffin wax, polyolefin wax, fatty acid amide wax and the like can be added to an extent not impairing the effects of the present invention, as needed.

As exemplary colorants usable in the present invention, may be mentioned black pigments such as carbon black, acetylene black, lamp black and magnetite; as well as known inorganic pigments such as chrome yellow, yellow iron oxide, hansa yellow G, quinoline yellow lake, permanent yellow NCG, molybdenum orange, vulcan orange, indanthrenes, brilliant orange GK, red iron oxide, brilliant carmine 6B, flizarin lake, methyl violet lake, fast violet B, cobalt blue, alkali blue lake, phthalocyanin blue, fast sky blue, pigment green B, malachite green lake, titanium oxide and zinc white. They may each be used in an amount of 5–250 parts by weight per 100 parts by weight of the resin.

The toner composition according to the present invention may be selectively added, for example, with nigrosine, a known charge control agent led by a metal-containing azo dye or a tertiary ammonium salt, a pigment dispersant, an offset inhibitor and the like and may then be converted into a toner by a method known per se in the art. Namely, the resultant resin mixture with the above various additives incorporated therein is premixed in a powdery form, kneaded in a heated and melted state in a kneader such as an extruder, cooled, comminuted finely by means of a pulverizer, and then classified by a pneumatic classifier to collect particles, generally, in a range of 8–20 μm as a toner. Specific conditions for these processings will become apparent from the examples to be described below and can be modified suitably as needed.

The present invention will hereinafter be described more specifically by the following examples, in which each unit is part or parts by weight or wt. % unless otherwise specifically indicated.

GPC AND MEASUREMENT OF THF-SOLUBLE CONTENT

The measurements of Mz, Mn and THF-soluble content by GPC were conducted in the following manner. Resin lumps were crushed, and particles not passed through a sieve with openings of 2 mm in diameter were collected. THF was added to those particles so that the resin concentration was adjusted to 10%. The resultant mixture was shaken for 24 hours, whereby the resin was dissolved. Insoluble matter was removed. The insoluble resin so removed was dried to determine the THF-soluble content. On the other hand, the THF-soluble matter was diluted further with THF, followed by the measurement by GPC under the following conditions:

| | |
|---|---|
| GPC apparatus: | JASCO TWINCLE HPLC |
| Detector: | SHODEX RI-SE-31 |
| Column: | SHODEX GPCA-80M × 2 + KF-802 × 1 |
| Solvent: | THF |
| Flow rate: | 1.2 ml/min |
| Sample: | 0.25% THF solution |

Copying applicability was determined under the following conditions by using an electrophotographic copying machine EP490Z (manufactured by MINOLTA CAMERA CO., LTD.) which was equipped with a TEFLON-coated hot roll.

BACKGROUND SCUMMING

The white background of the 100th copy and that of the 10,000th copy in a continuous copying operation, were compared. The background scumming was evaluated in accordance with the degree of scumming of the white background of the latter copy worsened due to scattered toner and the like. The results were ranked in accordance with the following standard:

A: Good.

B: Scumming was noticeable through a magnifier of ×30 magnification.

C: Scumming was noticeable by the naked eyes.

VARIATIONS IN THE ELECTRICITY TO BE CHARGED

The ratio (absolute value) of the quantity of triboelectricity on the 100th copy to that on the 10,000th copy in a continuous copying operation was expressed in accordance with the below-described calculation formula. Each toner composition was ranked good when this ratio was within 10 (%).

$$\frac{\text{Quantity of electricity charged after making 10,000 copies} - \text{Quantity of electricity charged after making 100 copies}}{\text{Quantity of electricity charged after making 100 copies}} \times 100(\%)$$

CONFIRMATION OF EXISTENCE OF UNMOLTEN RESIN

A slide glass was placed on a hot plate maintained at 250°–300° C. A small amount of a toner was placed and, concurrently with its melting, a cover glass was placed on the toner. The slide glass and the cover glass were press-bonded for 60 seconds while downwardly applying a constant pressure. The slide glass with the cover glass bonded thereon was removed from the hot plate. It was observed at ×400–×1,000 magnifications by a transmission electron microscope. Each sample was ranked as "A" where the existence of neither the colorant nor the charge control agent was observed and, when the existence or absence of resin-alone areas was looked for, the existence of resin-alone area or areas was not observed. Each sample was ranked as "B" where the existence of such resin-free area or areas was likely, and each sample was ranked as "C" where the existence of such resin-alone area or areas was observed.

DISPERSIBILITY OF CARBON BLACK

Toner lumps before their crushing were sliced by a microtome, and the uniformity of the carbon black and the existence or absence of agglomerates were observed at ×10000 magnification by a transmission electron microscope. Each sample was ranked as "A" where good uniformity was observed but as "B" where poor uniformity was observed. Further, each sample was ranked as "A" where no agglomerates were observed but as "B" where the existence of many agglomerates was observed.

DISPERSIBILITY OF CHARGE CONTROL AGENT

Toner lumps before their crushing were sliced by a microtome, and the degree of uniform dispersion of the charge control agent and the size of the charge control agent so dispersed were observed at ×4000 magnification by a transmission electron microscope. Each sample was ranked as "A" where good uniformity was observed but as "B" where poor uniformity was observed. Namely, each sample was ranked as "A" where the dispersed charge control agent was small and had a uniform size but as "B" where the dispersed charge control agent varied in size and was not uniform.

MEASUREMENTS OF $D_{25}$ and $D_{75}$

A standard, table-top sieve shaker, Model VSS-50, manufactured by Tsutsui Rikagaku Kikai K. K. was used with six sieves stacked on over another. The sieves were of the JIS-Z-8801-1982 standard and had the following mesh sizes downwardly: 9 mesh, 12 mesh, 16 mesh, 28 mesh, 60 mesh and 150 mesh. Cumulative weight percentages (%) were determined based on the corresponding cumulative minus-sieve weights. On a graph, particle sizes were plotted in logarithm along the axis of abscissas and the above cumulative weight percentages were plotted along the axis of ordinates. Those plots were connected by a smooth curve, whereby the particle size $D_{25}$ corresponding to the cumulative weight % of 25% and the particle size $D_{75}$ corresponding to the cumulative weight % of 75% were determined. However, where the resin passed through the 150-mesh sieve exceeded 25%, $D_{25}$ was extrapolated by connecting the datum of the particles passed through the 60-mesh sieve and that of the particles passed through the 150-mesh sieve.

RESIN PRODUCTION EXAMPLES

Resin Production Example 1

As monomers, 60 parts of styrene and 40 parts of butyl methacrylate were charged in a nitrogen-substituted flask. They were heated over an oil bath and polymerized for 4 hours by bulk polymerization while maintaining the internal temperature at 120° C. The polymerization rate according to the bulk polymerization without using any polymerization initiator was 32%. Then, the reaction mixture was added with 120 parts of xylene, followed by the gradual addition of 1 part of azobisisobutyronitrile (AIBN) and 80 parts of xylene, which had beforehand been mixed together into a solution, over 10 hours while the internal temperature was maintained at 100° C. After the reaction was continued for further 2 hours, the polymerization was finished. The results are shown in Table 1, in which the above polymer is designated as "A".

RESIN PRODUCTION EXAMPLE 2

A polymer was obtained as in Resin Production Example 1 except that the polymerization rate according to the bulk polymerization was raised to 50% by increasing the reaction time of the bulk polymerization. The results are shown in Table 1, in which the above polymer is designated as "B".

RESIN PRODUCTION EXAMPLE 3

A polymer was obtained as in Production Example 1 except that the polymerization rate of the bulk polymerization was changed to 15% by shortening the reaction time of the bulk polymerization. The results are shown in Table 1, in which the above polymer is designated as "C".

RESIN PRODUCTION EXAMPLE 4

Polymer D was obtained as in Resin Production Example 1 except that 0.6 part of divinylbenzene was added after the addition of 120 parts of xylene. The results are shown in Table 1.

RESIN PRODUCTION EXAMPLE 5

Polymer E was obtained as in Resin Production Example 4 except that the amount of divinylbenzene was changed to 1.5 part. The results are shown in Table 1.

RESIN PRODUCTION EXAMPLE 6

Polymer F was obtained as in Resin Production Example 1 except that the monomers were replaced by 30 parts of styrene, 30 parts of methyl methacrylate, 30 parts of butyl acrylate and 10 parts of methacrylic acid. The results are shown in Table 1.

RESIN PRODUCTION EXAMPLE 7

Polymer G was obtained as in Resin Production Example 1 except that the monomers were replaced by 70 parts of styrene, 28 parts of butyl acrylate and 2 parts of methacrylic acid. The results are shown in Table 1.

RESIN PRODUCTION EXAMPLE 8

In a flask, 100 parts of xylene were charged. At 120° C, a solution mixture composed of 90 parts of xylene, 10 parts of butyl acrylate and 1 part of AIBN was continuously added dropwise over 5 hours. The polymerization was continued for further 2 hours, thereby obtaining Polymer H. The results are shown in Table 1.

RESIN PRODUCTION EXAMPLE 9

In a flask, 100 parts of cumene were charged. At 155° C., a solution mixture composed of 90 parts of styrene, 10 parts of butyl acrylate and 5 parts of AIBN was continuously added dropwise over 5 hours. The polymerization was continued for further two hours, thereby obtaining Polymer I. The results are shown in Table 1.

RESIN PRODUCTION EXAMPLE 10

Polymer J was obtained as in Resin Production Example 9 except that the monomers were replaced by 38 parts of styrene, 50 parts of methyl methacrylate, 10 parts of butyl acrylate and 2 parts of methacrylic acid. The results are shown in Table 1.

PREPARATION OF STARTING RESIN LUMPS

After Polymers A-J obtained above were mixed at the resin ratios shown in Table 2, respectively, the resultant resin mixtures were separately subjected to solvent removal under heat in a vacuum and, subsequent to cooling, crushed in a hammer mill whereby Resin Lumps of R-1 to R-9 were obtained.

RESIN GRINDING CONDITIONS

Grinding Conditions I

Resin lumps were ground at the number of revolutions of 3000 rpm in a power mill Model P-3, (manufactured by San-Ei Seisakusho Ltd.), equipped with a screen in which circular openings of 4 mm were defined.

Grinding Conditions II

Resin lumps were ground in a similar manner to Grinding Conditions I except that the number of revolutions was changed to 2000 rpm.

Grinding Conditions III

Resin lumps were ground in a similar manner to Grinding Conditions I except the number of revolutions was changed to 4000 rpm.

Grinding Conditions IV

Resin lumps were ground in a similar manner to Grinding Conditions II except that the screen was replaced by a screen with circular openings of 8 mm perforated therein.

Grinding Conditions V

Resin lumps were ground in a similar manner to Example III except that the screen was replaced by a screen with circular openings of 0.35 mm perforated therein.

Grinding Conditions VI

A resin ground under Grinding Conditions IV was sifted by a 6-mesh sieve, thereby removing large particles of 6 mesh and greater.

Grinding Conditions VII

A resin ground under Grinding Conditions V was sifted by a 150-mesh sieve, thereby removing small particles of 150 mesh and smaller.

Grinding Conditions VIII

Resin lumps were ground in a similar manner to Grinding Conditions V except that the screen was replaced by a screen with circular openings of 0.55 mm perforated therein. The resin thus ground was sifted by a 60-mesh sieve to remove large particles of 60 mesh or greater and, in addition, by an 80-mesh sieve to remove small particles of 80 mesh and smaller.

Grinding Conditions IX

In a Henschel mixer, 50 parts of the resin ground under Grinding Conditions I and 50 parts of the resin ground under Grinding Conditions V were mixed.

Grinding Conditions X

In a Henschel mixer, 70 parts of the resin ground under Grinding Conditions I and 30 parts of the resin ground under Grinding Conditions IV were mixed.

Example

In a Henschel mixer, 100 parts of a binder, 10 parts of carbon black (MA-100: produced by Mitsubishi Kasei Corporation) as a colorant, 3 parts of propylene wax and 0.5–2 parts of nigrosine dye as a charge control agent were mixed. The resultant mixture was kneaded in a molten state in a twin-screw extruder at a temperature of 140° C. (inlet) to 150° C. (outlet). The mass so formed was cooled, crushed, pulverized in a jet mill and then air-classified, whereby a toner having a particle size of 8–20 μm (11 μm on average) was produced. The toner thus obtained was thereafter added and mixed with 0.15 part of colloidal silica in a Henschel mixer. The mixture was then subjected to tests.

The amount of the charge control agent was adjusted so that the quantity of triboelectricity by blow-off became 14 μC/g after 5 parts of the toner were mixed with 95 parts of a carrier for EP490Z at 45 rpm for 30 minutes in a twin-shell blender.

The test results of the above toner are shown in Table 3. It is evident from the results that the toner composition according to the present invention shows extremely good copying characteristics.

Incidentally, each molecular weight referred to in the present invention is defined as follows:

(1) Number-average molecular weight $$Mn = \frac{\Sigma MiNi}{\Sigma Ni}$$

(2) Z-average molecular weight $$Mz = \frac{\Sigma Mi^3Ni}{\Sigma Mi^2Ni}$$

where

Mi: molecular weight, and

N: number of molecules having the molecular weight Mi, per unit volume.

TABLE 1

| Polymer name | Polymer composition (parts by weight) Styrene | Methyl methacrylate | Butyl methacrylate | Butyl acrylate | Methacrylic acid | Divinyl benzene | Molecular weight Mz × $10^4$ | Mn × $10^4$ | Content of THF-soluble components (%) |
|---|---|---|---|---|---|---|---|---|---|
| Resin Production Example 1 A | 70 | | 10 | 20 | | | 63.2 | 2.8 | 100 |
| Resin Production Example 2 B | 70 | | 10 | 20 | | | 98.0 | 3.1 | 100 |
| Resin Production Example 3 C | 70 | | 10 | 20 | | | 35.6 | 1.3 | 100 |
| Resin Production Example 4 D | 70 | | 10 | 20 | | 0.6 | 118.1 | 2.5 | 88 |
| Resin Production Example 5 E | 70 | | 10 | 20 | | 1.5 | 144.9 | 2.8 | 43 |
| Resin Production Example 6 F | 30 | 30 | | 30 | 10 | | 110.2 | 3.0 | 100 |
| Resin Production Example 7 G | 70 | | | 28 | 2 | | 98.8 | 2.8 | 100 |
| Resin Production Example 8 H | 90 | | 10 | | | | 19.4 | 1.2 | 100 |
| Resin Production Example 9 I | 90 | | 10 | | | | 0.81 | 0.23 | 100 |
| Resin Production | 38 | 50 | | 10 | 2 | | 1.45 | 0.26 | 100 |

TABLE 1-continued

| Polymer name | Polymer composition (parts by weight) Styrene | Methyl methacrylate | Butyl methacrylate | Butyl acrylate | Methacrylic acid | Divinyl benzene | Molecular weight Mz × $10^4$ | Mn × $10^4$ | Content of THF-soluble components (%) |
|---|---|---|---|---|---|---|---|---|---|
| Example 10 J | | | | | | | | | |

TABLE 2

| Name of resin lumps | Polymer used Polymer name | Parts | Polymer name | Parts | Molecular weight Mz × $10^4$ | Mn × $10^4$ | Content of THF-soluble components (%) |
|---|---|---|---|---|---|---|---|
| R-1 | A | 50 | I | 50 | 62.2 | 0.43 | 100 |
| R-2 | B | 50 | I | 50 | 97.1 | 0.43 | 100 |
| R-3 | D | 50 | J | 50 | 116.5 | 0.47 | 94 |
| R-4 | E | 30 | J | 70 | 141.3 | 0.36 | 82 |
| R-5 | A | 25 | H | 75 | 45.1 | 1.40 | 100 |
| R-6 | G | 60 | J | 40 | 97.9 | 0.57 | 100 |
| R-7 | C | 100 | | | 35.6 | 1.30 | 100 |
| R-8 | E | 60 | J | 40 | 143.9 | 0.57 | 66 |
| R-9 | F | 60 | H | 40 | 106.3 | 1.88 | 100 |

TABLE 3-1

| | Binder Starting resin lumps | Grinding conditions | $D_{75}$ mm | $D_{25}$ mm | $D_{75}/D_{25}$ | Existance of unfused resin | Dispersibility of carbon black Uniformity | Agglomerates |
|---|---|---|---|---|---|---|---|---|
| Example 1 | R-1 | I | 2.0 | 0.43 | 4.7 | A | A | A |
| Example 2 | R-1 | II | 2.2 | 0.87 | 2.5 | A | A | A |
| Example 3 | R-1 | III | 1.6 | 0.7 | 2.3 | A | A | A |
| Comp. Ex. 1 | R-1 | IV | 3.6 | 1.8 | 2.0 | B | B | A |
| Comp. Ex. 2 | R-1 | V | 0.15 | 0.04 | 3.8 | A | A | B |
| Example 4 | R-1 | VI | 2.3 | 1.3 | 1.8 | A | A | A |
| Comp. Ex. 3 | R-1 | VII | 0.22 | 0.17 | 1.3 | A | A | B |
| Comp. Ex. 4 | R-1 | VIII | 0.23 | 0.21 | 1.1 | A | A | B |
| Comp. Ex. 5 | R-1 | IX | 1.0 | 0.08 | 12.5 | A | B | B |
| Example 5 | R-1 | X | 1.5 | 0.18 | 8.3 | A | A | A |
| Example 6 | R-2 | III | 1.6 | 0.38 | 4.2 | A | A | A |
| Example 7 | R-3 | III | 1.6 | 0.70 | 2.3 | A | A | A |
| Example 8 | R-4 | III | 1.2 | 0.50 | 2.4 | A | A | A |
| Example 9 | R-5 | III | 1.2 | 0.21 | 5.7 | A | A | A |
| Example 10 | R-6 | III | 1.5 | 0.82 | 1.8 | A | A | A |
| Comp. Ex. 6 | R-7 | III | 1.6 | 0.78 | 2.1 | A | A | B |
| Comp. Ex. 7 | R-8 | III | 1.5 | 0.85 | 1.8 | B | B | A |
| Comp. Ex. 8 | R-9 | III | 1.6 | 0.83 | 1.9 | A | B | A |

TABLE 3-2

| | Dispersibility of changing regulator | Copying applicability (State after copying 10,000 sheets) Background scumming | Variation in the quantity of electricity charged (%) | Filming | Damages to photosensitive member | Variations in picture density |
|---|---|---|---|---|---|---|
| Example 1 | A | A | 4.5 | Not observed | Not observed | Small |
| Example 2 | A | A | 7.3 | Not observed | Not observed | Small |
| Example 3 | A | A | 5.2 | Not observed | Not observed | Small |
| Comp. Ex. 1 | A | C | 14.5 | Not observed | Observed | Large |
| Comp. Ex. 2 | C | C | 16.3 | Not observed | Not observed | Large |
| Example 4 | A | A | 8.1 | Not observed | Not observed | Small |
| Comp. Ex. 3 | C | B–C | 13.1 | Not observed | Not observed | Large |
| Comp. Ex. 4 | C | B | 12.8 | Not observed | Not observed | Rather large |
| Comp. Ex. 5 | A | B | 11.2 | Not observed | Not observed | Rather large |
| Example 5 | A | A | 3.5 | Not observed | Not observed | Small |
| Example 6 | A | A | 6.3 | Not observed | Not observed | Small |
| Example 7 | A | A | 7.7 | Not observed | Not observed | Small |
| Example 8 | A | A | 5.4 | Not observed | Not observed | Small |
| Example 9 | A | A | 3.3 | Not observed | Not observed | Small |
| Example 10 | A | A | 8.5 | Not observed | Not observed | Small |
| Comp. Ex. 6 | C | B | 11.5 | Observed | Not observed | Rather large |
| Comp. Ex. 7 | C | C | 19.5 | Observed | Observed | Large |
| Comp. Ex. 8 | C | C | 10.5 | Not observed | Not observed | Rather large |

What is claimed is:

1. An electrophotographic toner composition comprising a binder and a colorant as principal components and obtained through kneading, grinding and classifying steps after the principal components have been mixed and dispersed in advance, characterized in that, before the mixing and dispersion the binder is obtained by first preparing at least one or more resins formed by a polymerization process selected from the group consisting of bulk polymerization process, solution polymerization and bulk polymerization followed by solution polymerization, removing solvent and unreacted monomers from the resin mixture prepared by each of said polymerization processes under heat in a vacuum, and mechanically crushing the resulting product, wherein at least 70 wt. % of the binder is soluble in tetrahydrofuran, the number average molecular weight (Mn) and Z average molecular weight (Mz) of a tetrahydrofuran-soluble portion as measured by using tetrahydrofuran are 2,000–15,000 and at least 400,000 respectively, and the particle size of the binder has been controlled so that $D_{75}$ is not greater than 2.5 mm, $D_{25}$ not smaller than 0.15 mm and $D_{75}/D_{25}$ at least 1.5.

2. The toner composition of claim 1, wherein Mz is at least 500,000.

3. The toner composition of claim 1, wherein Mz is not greater than 4,000,000.

4. The toner composition of claim 1, wherein at least 75 wt. % of the binder is soluble in tetrahydrofuran.

5. The toner composition of claim 1, wherein Mn is in a range of 2,000–10,000.

6. The toner composition of claim 1, wherein $D_{75}$ is not greater than 2 mm.

7. The toner composition of claim 1, wherein $D_{25}$ is not smaller than 0.17 mm.

8. The toner composition of claim 1, wherein $D_{75}/D_{25}$ is at least 1.8.

9. The toner composition of claim 1, wherein the binder is composed of one or more resins selected from the group consisting of acrylic ester resins, methacrylic acid resin, styrene resin, acrylic esters, styrene copolymer resins, methacrylic esters, styrene copolymer resins, acrylic esters, methacrylic esters, styrene copolymer resins, fumaric esters, styrene copolymer resins, maleic esters, styrene copolymer resins, and styrene, butadiene copolymer resins.

10. The toner composition of claim 9, wherein the resin is a polymer or copolymer of one or more monomers selected from the group consisting of aromatic vinyl monomers, acrylic acid esters, methacrylic acid esters and unsaturated carboxylic acids.

11. The toner composition of claim 9, wherein the resin has been obtained by subjecting an unsaturated monomer to bulk polymerization without using any polymerization initiator and then subjecting the resulting polymerization product in the presence of a polymerization initiator, a solvent and, if necessary, an unsaturated monomer to solution polymerization in the presence of the unreacted monomer.

12. The toner composition of claim 10, wherein a divinyl compound is added after bulk polymerization.

13. The toner composition of claim 1, wherein a polymer having a large Mz and a low molecular weight polymer, which has been produced in advance and has an Mn of 1,500–15,000, are molten, mixed and kneaded to prepare the binder.

14. The toner composition of claim 1, wherein, as the principal components, 5–250 parts by weight of the colorant are contained per 100 parts by weight of the binder.

15. The toner composition of claim 14, further comprising a charge control agent, a pigment dispersant, and an offset inhibitor.

16. The toner composition of claim 15, wherein the toner composition has been produced by premixing the binder, the colorant, the charge control agent, the pigment dispersant and the offset inhibitor, melting and kneading the resultant mixture in an extruder, and cooling, grinding and classifying the resultant mass into particle sizes of 8–20 μm.

* * * * *